US011324663B2

(12) United States Patent
Deck

(10) Patent No.: US 11,324,663 B2
(45) Date of Patent: May 10, 2022

(54) METHOD AND APPARATUS FOR TRANSFERRING A LIQUID DRUG TO A COLLAPSIBLE RESERVOIR

(71) Applicant: Roche Diabetes Care, Inc., Indianapolis, IN (US)

(72) Inventor: Frank Deck, Niederkirchen (DE)

(73) Assignee: ROCHE DIABETES CARE, INC., Indianapolis, IN (US)

( * ) Notice: Subject to any disclaimer, the term of this patent is extended or adjusted under 35 U.S.C. 154(b) by 300 days.

(21) Appl. No.: 16/340,736

(22) PCT Filed: Nov. 20, 2017

(86) PCT No.: PCT/EP2017/079714
§ 371 (c)(1),
(2) Date: Apr. 10, 2019

(87) PCT Pub. No.: WO2018/091700
PCT Pub. Date: May 24, 2018

(65) Prior Publication Data

US 2019/0314246 A1 Oct. 17, 2019

(30) Foreign Application Priority Data

Nov. 21, 2016 (EP) ..... 16199860

(51) Int. Cl.
*A61J 1/20* (2006.01)
*A61J 1/10* (2006.01)
(Continued)

(52) U.S. Cl.
CPC ..... *A61J 1/2089* (2013.01); *A61J 1/10* (2013.01); *B65B 3/003* (2013.01); *A61J 1/2075* (2015.05); *B65B 31/024* (2013.01)

(58) Field of Classification Search
CPC ..... A61J 1/10; A61J 1/2089; A61J 1/1493; B65B 3/003; B65B 31/024
See application file for complete search history.

(56) References Cited

U.S. PATENT DOCUMENTS 4,922,975 A * 5/1990 Polaschegg ..... A61J 3/002 141/104
8,720,496 B2 * 5/2014 Huwiler ..... A61M 5/14244 141/65

(Continued)

FOREIGN PATENT DOCUMENTS

EP 2 319 477 5/2011

*Primary Examiner* — Timothy P. Kelly
(74) *Attorney, Agent, or Firm* — Woodard, Emhardt, Henry, Reeves & Wagner, LLP

(57) ABSTRACT

The invention concerns a method and an apparatus for transferring an amount of a liquid drug (11) from a supply container (1) having stored the liquid drug (11) to a collapsible reservoir (2), the method including and the apparatus enabling the steps of:

a) providing a fluid connection (3) between the supply container (1) and the collapsible reservoir (2);
b) subjecting the liquid drug (11) stored in the supply container (1) to an environmental pressure;
c) subjecting the collapsible reservoir (2) to a positive pressure relative to the environmental pressure, thereby collapsing the collapsible reservoir (2) and transferring gas comprised in the collapsible reservoir (2) from the collapsible reservoir (2) to the supply container (1);
d) subjecting the collapsible reservoir (2) to a negative pressure relative to the environmental pressure, thereby expanding the collapsible reservoir (2) and transferring the amount of the liquid drug (11) from the supply container (1) to the collapsible reservoir (2).

12 Claims, 5 Drawing Sheets

(51) Int. Cl.
*B65B 3/00* (2006.01)
*B65B 31/02* (2006.01)

(56) References Cited

U.S. PATENT DOCUMENTS

| | | | | |
|---|---|---|---|---|
| 2003/0052065 | A1 | 3/2003 | Rosiello | |
| 2009/0053107 | A1 | 2/2009 | Holger | |
| 2009/0163866 | A1 * | 6/2009 | Hines ..... | A61M 5/14212 604/131 |

* cited by examiner

METHOD AND APPARATUS FOR TRANSFERRING A LIQUID DRUG TO A COLLAPSIBLE RESERVOIR

FIELD OF THE INVENTION

The present invention relates to a method and an apparatus for transferring an amount of a liquid drug from a supply container having stored the liquid drug to a collapsible reservoir.

BACKGROUND ART

For the administration of liquid drugs, patients can use various types of reservoirs for storing the liquid drug. The reservoirs may be designed for use in connection with infusion pump devices such as insulin pumps. The reservoirs may be designed to be filled one or more times by the patients. An advantage of filling a reservoir by a patient is that the patient can use drugs which are not widely used and which therefore are not available in pre-filled reservoirs. In some embodiments, reservoirs may have a flexible and/or a collapsible design. A collapsible reservoir may be delivered in a collapsed and empty state enabling that the patient can readily start filling the collapsible reservoir without further manipulations. However, the flexibility of the collapsible reservoir effects that in the empty state the collapsible reservoir ends up into a specific form. Accordingly, the collapsible reservoir is not completely empty and has stored an undefined amount of air. Hence, after the collapsible reservoir has been filled with the liquid drug, the collapsible reservoir contains the liquid drug and an undefined amount of air, for example in the form of air bubbles. Air or air bubbles in the liquid drug stored in the collapsible reservoir must be prevented, because air or air bubbles may react with the liquid drug, because the exact volume of the liquid drug stored in the collapsible container cannot be determined, because delivery of the liquid drug containing air or air bubbles may be harmful to the patient, because air or air bubbles may have a negative effect on the proper occlusion detection in the delivery system during delivery of the liquid drug, etc. These problems may become even worse, because the amount of air stored in the collapsible reservoir is often undefined or unknown. For example, if the collapsible reservoir has stored an undefined or unknown amount of air, determining exactly the amount of liquid drug stored in the collapsible reservoir may become practically impossible.

EP2319477 discloses a device for transferring a liquid medicament from a supply container to a flexible reservoir container. A compartment unit has a sealingly closable chamber, arranged for housing the flexible reservoir container and for being fluidly connected with a pump mechanism. An adapter unit comprises a transfer passage for transferring liquid from the supply container connected to the adapter unit to the flexible reservoir container, and a separator unit arranged in the transfer passage for separating gas bubbles from a liquid streaming through the transfer passage. The separation of the gas bubbles is advantageously effected by a negative pressure in the chamber of the compartment unit. The separator can comprise a liquid-impermeable, gas-permeable membrane. The flexible reservoir container can be subjected to a reduced ambient pressure, thereby generating a negative pressure inside of the flexible reservoir container, and normal ambient pressure can be sustained inside of the supply container, and the liquid is conveyed from the supply container to the flexible reservoir container, driven by the pressure difference between the inside of the supply container and the inside of the flexible reservoir container. Prior to filling, the flexible reservoir container is evacuated via the separator, which is designed in such a way that the flexible reservoir container is fluidly connected to its surroundings with its reduced ambient pressure as long as the separator has not yet come into contact with liquid.

U.S. Pat. No. 4,817,687 discloses a filling device for sterile filling of containers. A flexible temporary storage container is placed in a dosage chamber and exposed to external over-pressure and under-pressure. The filling good is sucked into the temporary storage container and pressed out to the final storage container. The dosage chamber has an inlet and an outlet having valve devices synchronized to the overpressure and under-pressure for arranging for the proper operation sequence.

U.S. Pat. No. 5,437,201 discloses an apparatus for collecting fluid samples. The apparatus has a sealable container with an opening and a cover for sealing and unsealing the opening, an inlet which includes a means for communicating between the inside of the container and the environment outside the container, a sample vessel which has an orifice for filling and sealing it when samples are drawn therein through the inlet, and a means for selectively evacuating and pressurizing the space between the vessel and the container, which induces the vessel to alternately be filled with fluid from the environment outside the container and emptied of its contents to the environment through the inlet.

WO2012139878 discloses a device for moving a piston inside a cartridge that has a cartridge body and the piston arranged therein displaceable along a longitudinal axis of the cartridge. A first portion has a first coupling means for releasably coupling the cartridge body such that there exists a positive connection and/or a frictional connection. A second portion has second coupling means for releasably coupling the piston such that there exists a positive connection and/or a frictional connection. The first portion and the second portion are moveable relative to each other in order to effect a forward displacement of the piston inside the cartridge body. The shape of the second coupling means can be reversibly changed for establishing a connection with the piston. The piston is moved forwards inside the cartridge body, thereby reducing the volume of the inside of the cartridge and thus displacing air from the inside of the cartridge into an insulin reservoir, until the fully extended position of the piston has been reached.

DISCLOSURE OF THE INVENTION

It is an object of the present invention to provide a method and an apparatus for transferring an amount of a liquid drug from a supply container having stored the liquid drug to a collapsible reservoir, which do not have at least some of the disadvantages of the prior art. In particular, it is an object of the present invention to provide a method and an apparatus for transferring an amount of a liquid drug from a supply container having stored the liquid drug to a collapsible reservoir, wherein the amount of gas such as air stored in the collapsible reservoir is reduced. In particular, it is an object of the present invention to provide a method and an apparatus for transferring an amount of a liquid drug from a supply container having stored the liquid drug to a collapsible reservoir, wherein the amount of liquid drug stored in the collapsible reservoir can be determined more exactly.

According to the present invention, these objects are achieved through the features of the independent claims. In addition, further advantageous embodiments follow from the dependent claims and the description.

According to the present invention, the above-mentioned objects are particularly achieved by a method for transferring an amount of a liquid drug from a supply container having stored the liquid drug to a collapsible reservoir, wherein the method includes the steps of:

a) providing a fluid connection between the supply container and the collapsible reservoir;

b) subjecting the liquid drug stored in the supply container to an environmental pressure;

c) subjecting the collapsible reservoir to a positive pressure relative to the environmental pressure, thereby collapsing the collapsible reservoir and transferring gas comprised in the collapsible reservoir from the collapsible reservoir to the supply container;

d) subjecting the collapsible reservoir to a negative pressure relative to the environmental pressure, thereby expanding the collapsible reservoir and transferring the amount of the liquid drug from the supply container to the collapsible reservoir.

The gas is preferably air. The environmental pressure is preferably the ambient pressure, i.e. the ambient pressure where the method steps are performed for transferring an amount of liquid drug from the supply container having stored the liquid drug to the collapsible reservoir. By selecting a predetermined positive pressure and collapsing the collapsible reservoir to a predetermined collapsed state, gas can be partly or practically completely removed from the collapsible reservoir, enabling that the collapsible reservoir has stored nearly zero or zero gas. By selecting a predetermined negative pressure and expanding the collapsible reservoir to a predetermined expanded state, a predetermined amount of liquid drug can be transferred to the collapsible reservoir, enabling that the amount of liquid drug stored in the collapsible reservoir can be more exactly determined.

An embodiment of the method includes: carrying out a repeated sequence of subjecting the collapsible reservoir to a positive pressure relative to the environmental pressure and of subjecting the collapsible reservoir to a negative pressure relative to the environmental pressure. By subjecting the collapsible reservoir repeatedly to a positive and a negative pressure, residual gas can be removed from the collapsible reservoir.

An embodiment of the method includes: arranging a separator configured to extract gas comprised in the collapsible reservoir. For example, the separator can be arranged at the fluid connection or at the collapsible reservoir. The separator can have a design that enables that gas can pass the separator, wherein the liquid drug cannot pass the separator. Accordingly, the amount of gas stored in the collapsible reservoir can be further reduced. For example, the separator can be arranged at the collapsible reservoir and can have a design that enables that the liquid drug can pass the separator, wherein gas cannot pass the separator. During use of the collapsible reservoir, for example when the collapsible reservoir is arranged in a system for administering the liquid drug, residual gas stored in the flexible reservoir can be blocked from being transferred from the collapsible reservoir to a system for administering the liquid drug.

An embodiment of the method includes: determining a parameter reflecting the amount of remaining gas in the collapsible reservoir, the parameter being determined in particular by one or more of: measuring a pressure gradient, and optically determining the amount of gas being transferred to the supply container. For example, the sequence of subjecting the collapsible reservoir to a positive pressure and to a negative pressure can be repeated until the parameter reflects that the collapsible reservoir has stored only a predetermined amount of gas or less.

An embodiment of the method includes: providing via an environment connection a gas connection between a gas in an environment of the supply container having the environmental pressure and a gas stored together with the liquid drug in the supply container. Thereby, in particular, the liquid drug stored in the supply container is subjected to the environmental pressure.

An embodiment of the method includes: arranging the collapsible reservoir within a pressure chamber being configured to subject the collapsible reservoir to the positive pressure and to the negative pressure, the positive pressure and the negative pressure being in particular effectible by a pump device connected to the pressure chamber. The pressure chamber can be designed to enable that the collapsible reservoir can be subjected to a predetermined maximum positive pressure and/or to a predefined minimum negative pressure. For example, a higher maximum positive pressure can enable that very few or almost zero gas remains in the collapsible reservoir. For example, a lower minimum negative pressure can enable that a predefined amount of liquid drug can be transferred into the collapsible reservoir and/or that the liquid drug can be transferred to the collapsible reservoir within a predefined time window.

An embodiment of the method includes: providing the fluid connection between the collapsible reservoir and the supply container by fluidly connecting a port of the collapsible reservoir and a port of the supply container. The port of the collapsible reservoir and the port of the supply container can have a design that enables a robust fluid communication. For example, air-tight design enables that no gas is transferred from the environment to the collapsible reservoir.

An embodiment of the method includes: arranging the supply container at a higher level above ground than the collapsible reservoir. Accordingly, the gravity of earth additionally supports transferring an amount of the liquid drug from the supply container to the collapsible reservoir.

The invention further relates to an apparatus for transferring an amount of a liquid drug from a supply container having stored the liquid drug to a collapsible reservoir, the apparatus including:

a) a fluid connection configured to provide a fluidic communication between the supply container and the collapsible reservoir;

b) an environment connection configured to subject the liquid drug stored in the supply container to an environmental pressure;

c) a pressure chamber configured to subject the collapsible reservoir to a positive pressure relative to the environmental pressure, thereby collapsing the collapsible reservoir and transferring a gas comprised in the collapsible reservoir from the collapsible reservoir to the supply container; wherein d) the pressure chamber is further configured to subject the collapsible reservoir to a negative pressure relative to the environmental pressure, thereby expanding the collapsible reservoir and transferring the amount of the liquid drug from the supply container to the collapsible reservoir.

In an embodiment of the apparatus, the pressure chamber is configured to repeatedly subject the collapsible reservoir to a positive pressure and a negative pressure relative to the environmental pressure.

In an embodiment, the apparatus further includes a pump device which is connected to the pressure chamber and which enables to subject the collapsible reservoir to a positive pressure relative to the environmental pressure and/or to subject the collapsible reservoir to a negative pressure relative to the environmental pressure.

In an embodiment, the apparatus further includes a valve device which is connected to the pressure chamber and which enables to subject the collapsible reservoir to the environmental pressure.

In an embodiment, the apparatus further includes a sensor device 9 for determining a parameter reflecting the amount of remaining gas in the collapsible reservoir, the parameter being determined in particular by one or more of: pressure measuring device for measuring a pressure gradient, and optical sensor device for optically determining the amount of gas being transferred to the supply container.

In an embodiment, the apparatus further includes a support for arranging the supply container at a higher level above ground than the collapsible reservoir.

The invention further relates to a kit comprising an apparatus according to the invention, further comprising one or more collapsible reservoirs. The number of collapsible reservoirs included in the kit can correspond to the expected lifetime of the apparatus and the expected lifetime of the collapsible reservoirs. For example, if the expected lifetime of the apparatus is twelve months and the expected lifetime of a collapsible reservoir is three months, the kit can include four collapsible reservoirs. In a variant, the number of collapsible reservoirs can correspond to the expected number of collapsible reservoirs required during a predefined time period, such as for one month of usage. For example, if the collapsible reservoir has a disposable design and after each use a new collapsible reservoir is required every day, the kit can include thirty collapsible reservoirs.

In an embodiment, the collapsible reservoir can be designed to be used only once, such that the liquid drug is transferred each time into a brand-new "empty" collapsible reservoir. In another embodiment, the collapsible reservoir can be reusable.

BRIEF DESCRIPTION OF THE DRAWINGS

The herein described invention will be more fully understood from the detailed description given herein below and the accompanying drawings which should not be considered limiting to the invention described in the appended claims. The drawings are illustrating schematically:

MODE(S) FOR CARRYING OUT THE INVENTION

Figure 1:
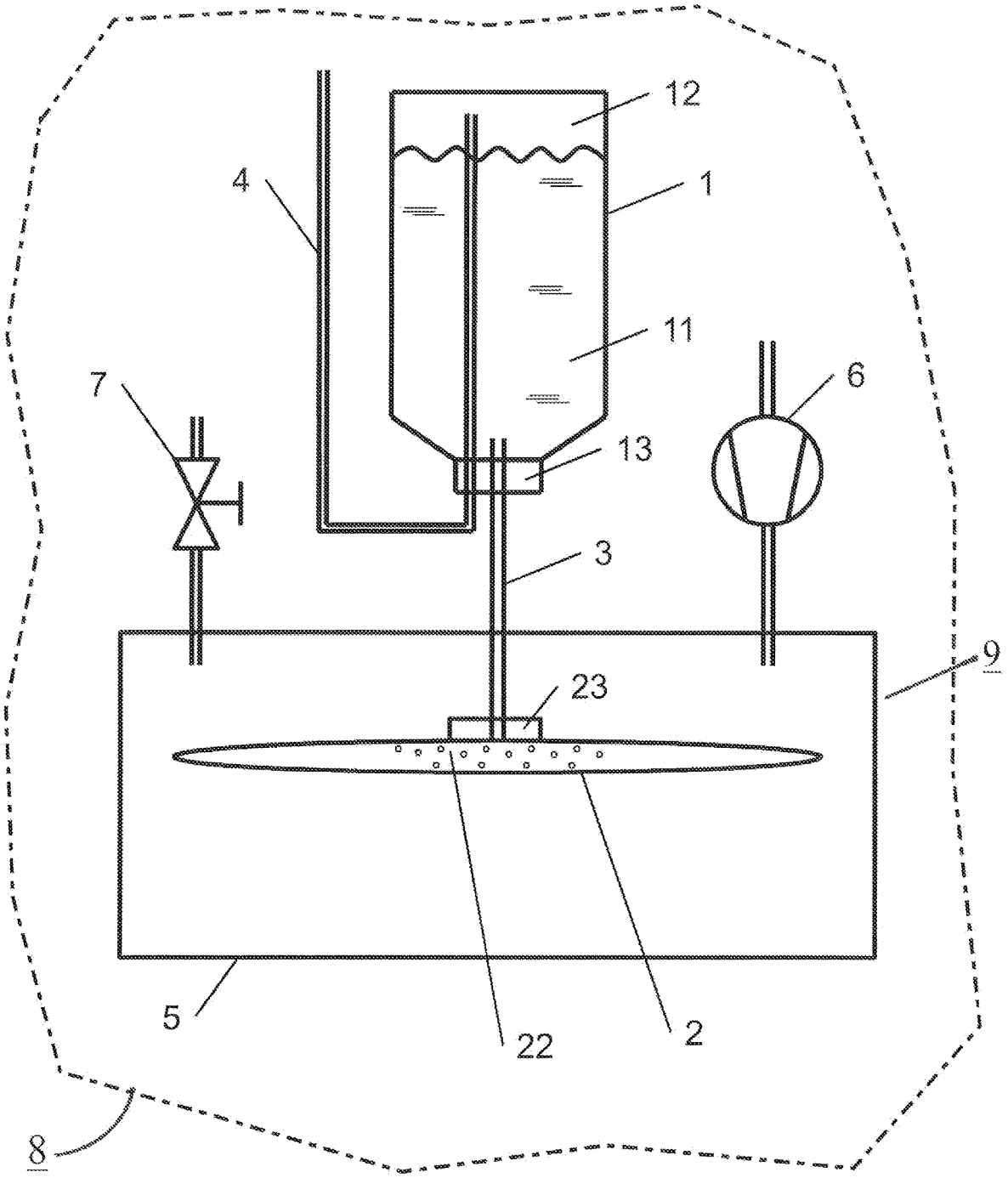
FIG. 1 illustrates schematically a supply container connected via a fluid connection with a collapsible reservoir, wherein the collapsible reservoir is in a relaxed collapsed state.

FIG. 1 illustrates schematically a supply container 1 connected via a fluid connection 3 with a collapsible reservoir 2. The collapsible reservoir 2 is in a relaxed state, as will be described in more detail below. The fluid connection 3 enables a fluid communication between the supply container 1 and the collapsible reservoir 2. Thus, the fluid connection 3 enables that a fluid such as a gas, a liquid drug, etc. can flow or can be transferred between the supply container 1 and the collapsible reservoir 2, in particular between an inner space of the supply container 1 and an inner space of the collapsible reservoir 2.

The collapsible reservoir 2 can be designed to be arranged into a liquid drug pump, such as an insulin pump, for administering the liquid drug to a patient.

The gas referred to in the present description is preferably air. It is possible that the gas includes or consists of other components.

The supply container 1 can have a rigid design. In other embodiments, the supply container 1 can have a flexible design. In some embodiments, the supply container 1 is a vial, an injection pen, etc. The supply container 1 has stored a liquid drug 11. In particular, the liquid drug 11 is stored in an inner space of the supply container 1. In some embodiments, the liquid drug 11 includes or consists of insulin, glucagon, long-term medication, hormones, analgesics, cancer therapeutics, etc.

The supply container 1 can have stored the liquid drug 11 up to a predefined fill level, wherein the remaining inner space of the supply container 1 can contain a gas 12. Accordingly, the supply container 1 can have stored the liquid drug 11 and the gas 12.

In some embodiments, an environment connection 4 enables a fluid communication between the environment of the supply container 1 and the inner space of the supply container 1. In particular, the environment connection 4 enables a fluid communication between the environment of the supply container 1 and the gas 12 stored in the supply container 1. Accordingly, the liquid drug 11 stored in the supply container 1 is subjected to the environmental pressure, which is preferably the ambient pressure. If the pressure inside the supply container 1 is lower than in the environment, gas is transferred from the environment through the environment connection 4 into the supply container 1. If the pressure inside the supply container 1 is higher than in the environment, gas is transferred from the supply container 1 through the environment connection 4 into the environment.

In some embodiments, the environment connection 4 is configured such that a fluid communication between the liquid drug 11 and the environment is blocked or at least hindered, thereby preventing that liquid drug 11 can flow from the supply container 1 to the environment. As illustrated in the Figures, this can be achieved for example by an environment connection 4 having the form of an "U".

In some embodiments, the supply container 1 includes a port 13. In some embodiments, the collapsible reservoir 2 includes a port 23. In some embodiments, the port 13 of the supply container 1 is connected via the fluid connection 3 to the port 23 of the collapsible reservoir 23, thereby providing a fluid communication between the supply container 1 and the collapsible reservoir 2. In some embodiments, the port 13 of the supply container 1 is directly connected to the port 23 of the collapsible reservoir 2, wherein the fluid connection 3 is provided directly via the port 13 of the supply container 1 and the port 23 of the collapsible reservoir 2.

Figure 2:
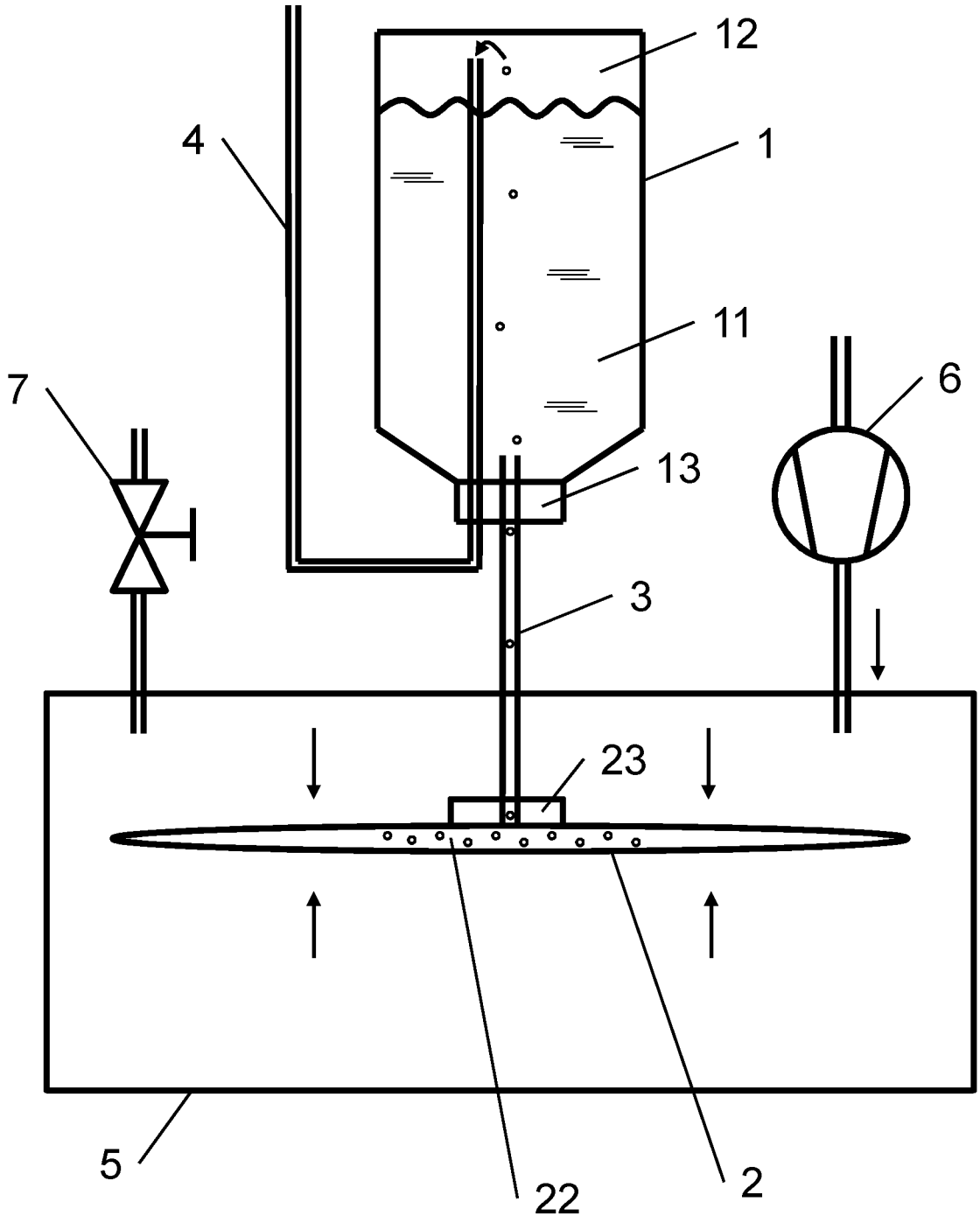
FIG. 2 illustrates schematically a supply container connected via a fluid connection with a collapsible reservoir, wherein the collapsible reservoir is in a nearly collapsed state.
Figure 3:
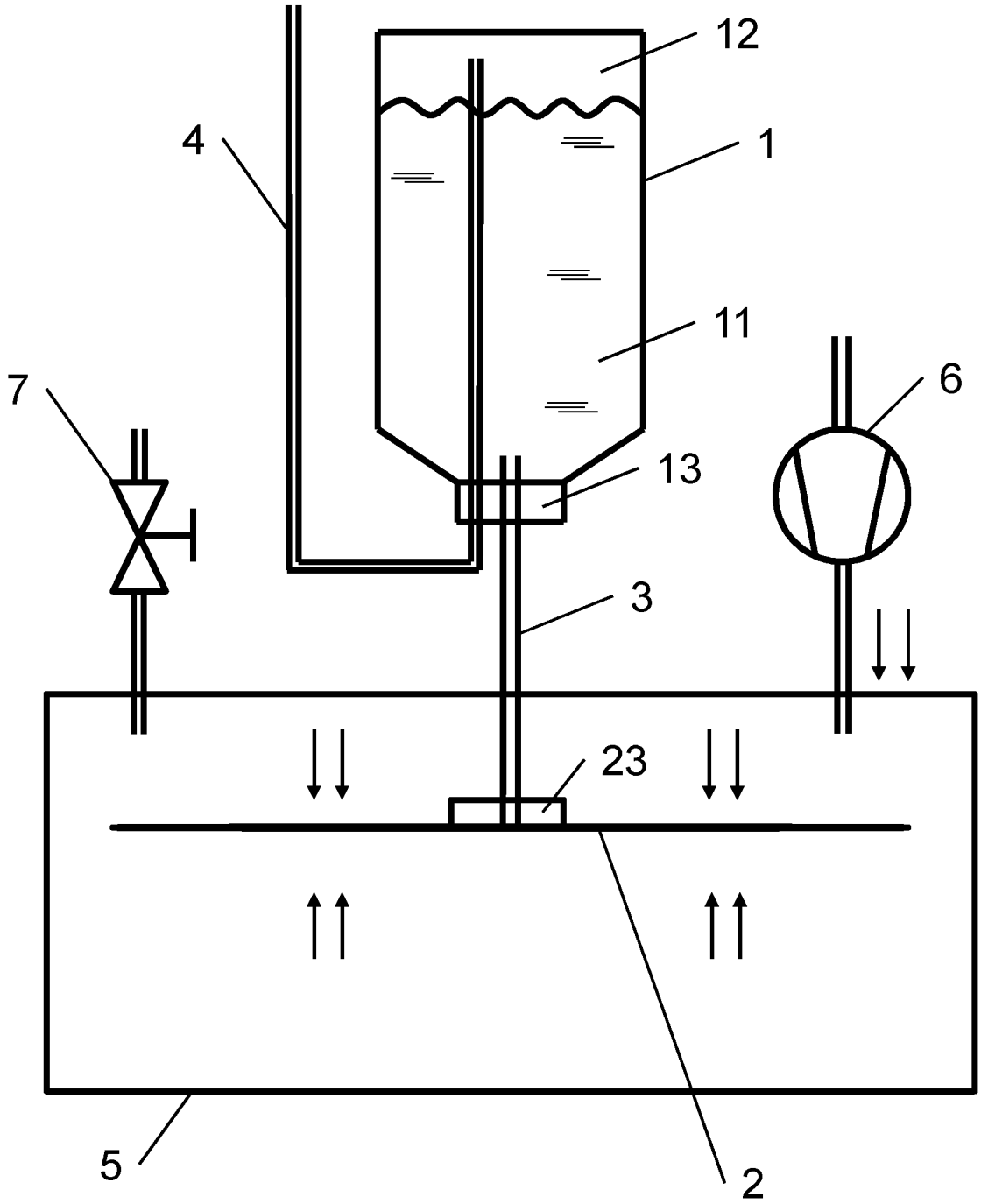
FIG. 3 illustrates schematically a supply container connected via a fluid connection with a collapsible reservoir, wherein the collapsible reservoir is in a collapsed state.
Figure 5:
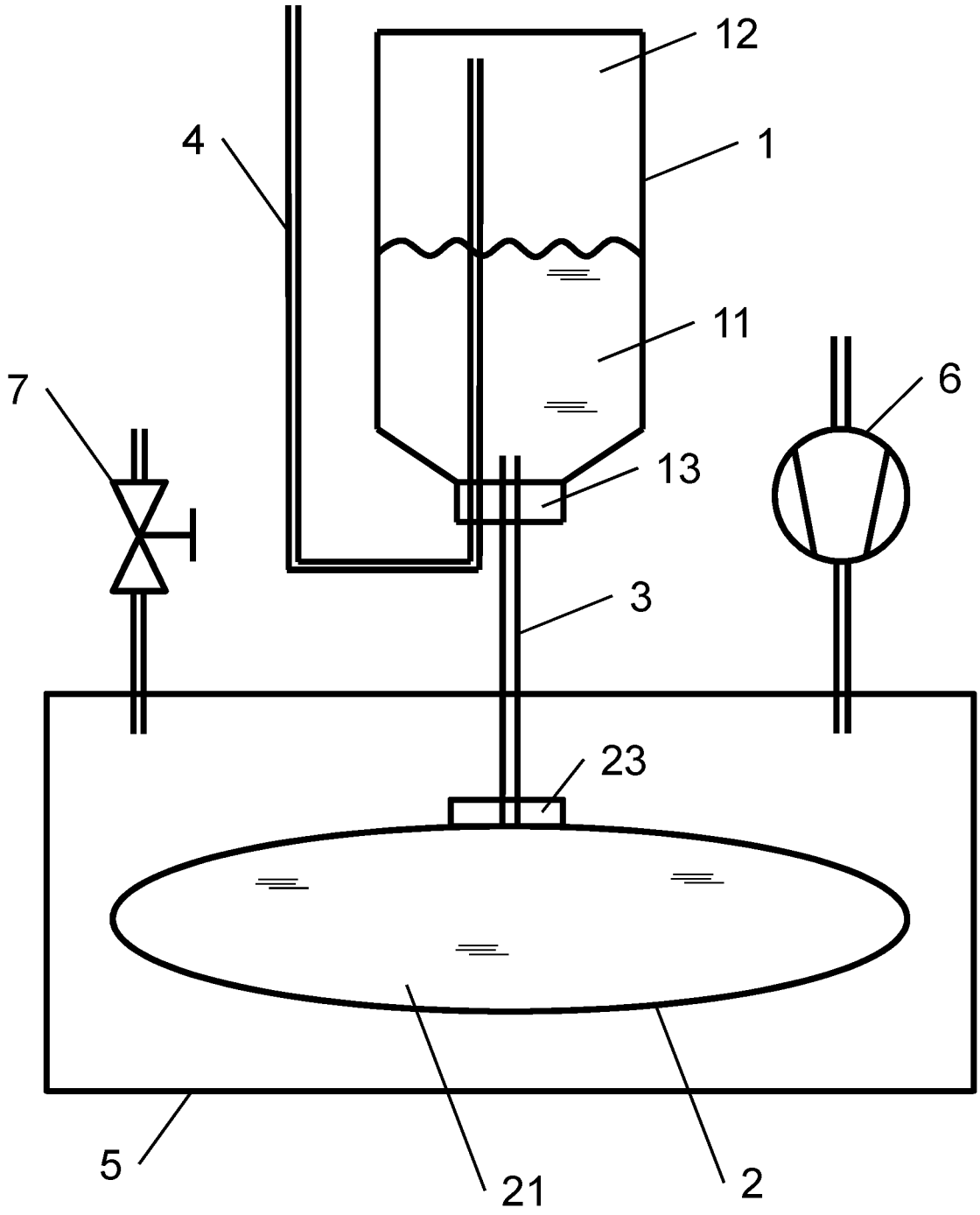
FIG. 5 illustrates schematically a supply container connected via a fluid connection with a collapsible reservoir, wherein the collapsible reservoir is in an expanded state.

The collapsible reservoir 2 has a collapsible design, enabling that the collapsible reservoir can be in a collapsed state, as illustrated in FIG. 3, in an expanded state, as illustrated in FIG. 5, and in any state there between, which can include a relaxed state, as illustrated in FIG. 1, a nearly collapsed state, as illustrated in FIG. 2, and a partly expanded state, as illustrated in FIG. 5. The collapsible reservoir 2 can include a flexible material enabling or providing the collapsible design. In the collapsed state, the collapsible reservoir 2 includes an inner space of an essentially zero volume. In the expanded state, the collapsible reservoir 2 includes an inner space of a predefined volume in order to enable storage of the liquid drug 21.

FIG. 1 illustrates the relaxed state of the collapsible reservoir 2, wherein the collapsible reservoir 2 is empty and is subjected to environmental pressure, wherein an amount of gas 22 is stored in the collapsible container 2. For example, the collapsible reservoir 2 has been discharged and has been put in an environment having a usual environmental pressure. However, because the collapsible design is for example enabled by a flexible material, the collapsible reservoir 2 has ended up into a specific, not completely collapsed state, namely the relaxed state. Accordingly the collapsible reservoir 2 includes an inner space with a volume that is not completely zero and has stored an undefined amount of gas 22.

FIG. 2 illustrates schematically the nearly collapsed state of the collapsible reservoir 2, wherein a smaller amount of gas 22 is still stored in the collapsible container 2 than in the relaxed state. In particular, in the nearly collapsed state, the collapsible reservoir 2 is subjected to a positive pressure.

FIG. 3 illustrates schematically the collapsed state of the collapsible reservoir 2, wherein the inner volume of the collapsible reservoir 2 is zero and practically no gas 22 is stored in the collapsible container 2.

Figure 4:
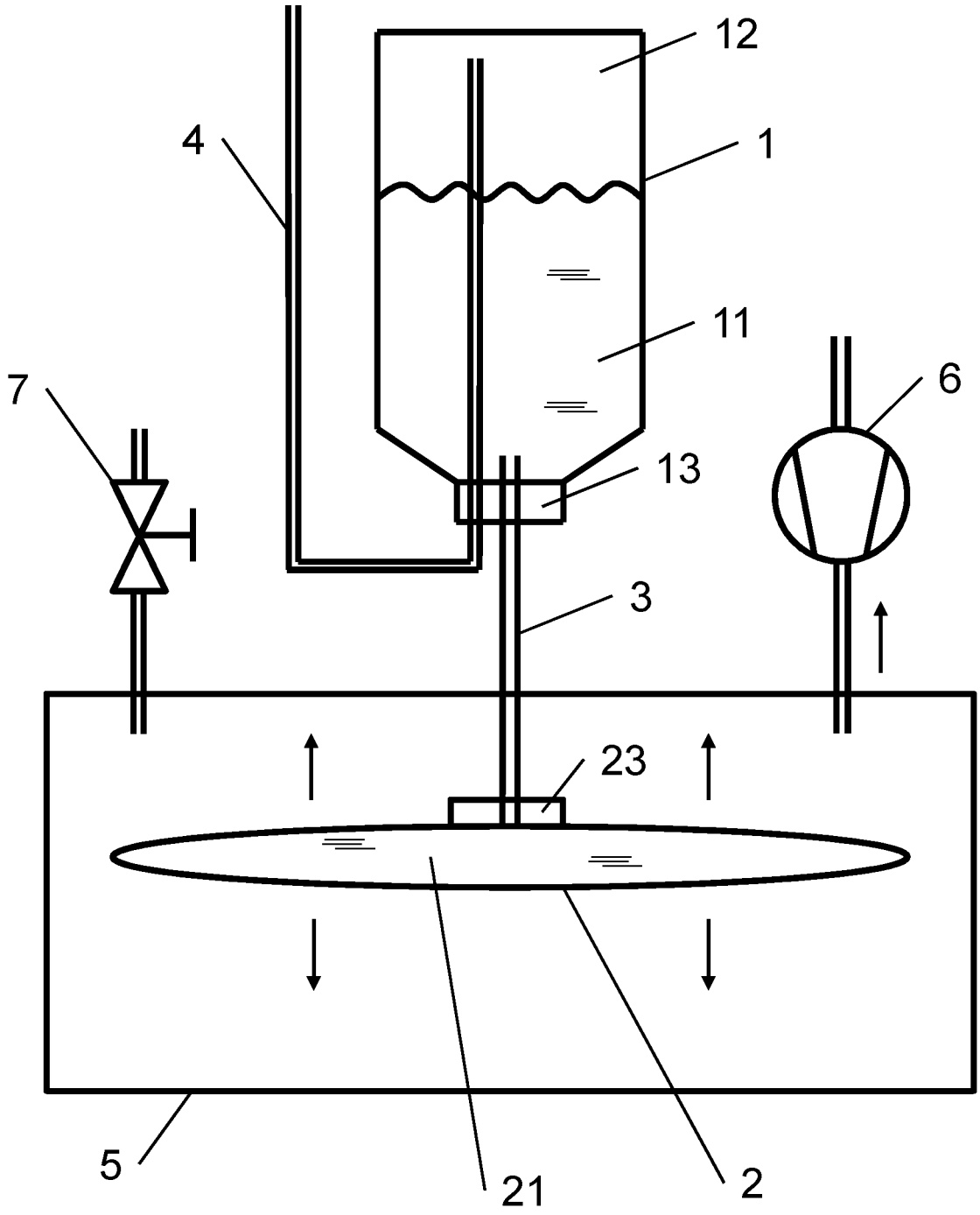
FIG. 4 illustrates schematically a supply container connected via a fluid connection with a collapsible reservoir, wherein the collapsible reservoir is in a partly expanded state.

FIG. 4 illustrates the collapsible reservoir 2 in a partly expanded state, wherein an amount of liquid drug 21 is stored in the collapsible reservoir 2.

FIG. 5 illustrates the collapsible reservoir 2 in an expanded state, wherein a larger amount of liquid drug 21 is stored in the collapsible reservoir 2 than as illustrated in FIG. 4.

As schematically illustrated in FIG. 1, the supply container 1 is arranged within a pressure chamber 5. The pressure chamber 5 has a closed inner space that includes a fluid such as a gas, air, a liquid, etc. An outside of the pressure chamber 5 is at environmental pressure. The inner space of the pressure chamber 5 is adjustable to a positive pressure relative to the environmental pressure, to a negative pressure relative to the environmental pressure or to environmental pressure. The positive pressure is a pressure that is greater or higher than the environmental pressure. The negative pressure is a pressure that is smaller or lower than the environmental pressure.

In some embodiments, in order to adjust the pressure at the inside of the pressure chamber 5, a pump device 6 can be connected to the pressure chamber 5. The pump device 6 can be configured to pump a fluid such as a gas, air, a liquid, etc. into the pressure chamber 5, in particular in order to adjust the inside of the pressure chamber 5 to a positive pressure relative to the environmental pressure. The pump device 6 can be configured to withdraw a fluid such as a gas, air, a liquid, etc. from the pressure chamber 5, in particular in order to adjust the inside of the pressure chamber 5 to a negative pressure relative to the environmental pressure. The pump device 6 can be configured to establish the environmental pressure at the inside of the pressure chamber 5.

In some embodiments, the pump device 6 has a manually operable design. In other embodiments, the pump device 6 has an electrically operable design. In some embodiments, the pump device 6 comprises a cylinder and a movably arranged piston. In some embodiments, the pump device 6 is a syringe.

In some embodiments, in order to adjust the pressure at the inside of the pressure chamber 5 to the environmental pressure, a valve device 7 can be connected to the pressure chamber 5. The valve device 7 can be configured to establish a fluid communication between the inside of the pressure chamber 5 and the outside of the pressure chamber 5, such that the environmental pressure at the outside of the pressure chamber 5 is also established at the inside of the pressure chamber 5.

In some embodiments, the valve device 7 has a manually operable design. In other embodiments, the valve device 7 has an electrically operable design.

In some embodiments, operation of the pump device 6 and/or the valve device 7 can be controlled by a control device 8, such as a medical control device, a remote control, a smartphone, etc.

As illustrated in FIG. 1, the collapsible reservoir 2 is arranged in the pressure chamber 5. In the relaxed state, the collapsible reservoir 2 includes a gas 22 and therefore is not completely empty.

As illustrated in FIG. 2, the collapsible reservoir 2 is subjected to a positive pressure relative to the environmental pressure, in particular by operating the pump device 6. Thereby, the collapsible reservoir 2 is collapsed and the gas 22 comprised in the collapsible reservoir 2 is transferred from the collapsible reservoir 2 to the supply container 1. As illustrated in FIG. 2, by collapsing the collapsible reservoir 2, gas passes through the fluid connection 3, gas enters into the liquid drug 11, gas passes through the liquid drug 11 to the gas 12 stored in the supply container 1, which increases the pressure above environmental pressure, gas therefore enters the environment connection 4, gas passes through the environment connection 4, and gas exits into the environment outside the supply container 1. Accordingly, gas can escape from the collapsible reservoir 2 to the environment.

For example, as illustrated schematically in FIG. 3 by the two parallel arrows, inside the pressure chamber 5, the positive pressure relative to the environmental pressure can be increased to a predefined level such that only a predefined residual amount of gas 22 remains in the collapsible reservoir 2. In case the collapsible reservoir 2 is fully collapsed, such that the volume inside the collapsible reservoir 2 is zero, the residual amount of gas 22 is zero as well. A residual amount of gas may still remain in the fluid connection 3 between the flexible reservoir 2 and the supply container 1.

As illustrated in FIG. 4, the collapsible reservoir 2 is subjected to a negative pressure relative to the environmental pressure, for example by operating the pump device 6 in an opposite direction. Thereby, the collapsible reservoir 2 is expanded and an amount of the liquid drug 11 is transferred from the supply container 1 to the collapsible reservoir 2. Accordingly, the collapsible reservoir 2 has stored the liquid drug 21, which was transferred from the supply container 1.

For example, inside the pressure chamber 5, the negative pressure relative to the environmental pressure can be reduced to a predefined level such that a predefined amount of liquid drug 11 is transferred from the supply container 1 to the collapsible reservoir 2.

After an amount of liquid drug 11 has been transferred from the supply container 1 to the collapsible reservoir 2, the collapsible reservoir 2 can be subjected again to a positive pressure relative to the environmental pressure, thereby transferring possibly gas, that maybe still has remained in the collapsible reservoir 2, and liquid drug 21 from the collapsible reservoir 2 to the supply container 1. The gas possibly transferred to the supply container 1 can escape to the environment as described above. The collapsible reservoir 2 can be subjected again to a negative pressure relative to the environment pressure, thereby transferring liquid drug 11 from the supply container 1 to the collapsible reservoir 2. Accordingly, the amount of gas that maybe still has remained in the collapsible reservoir 2 can be reduced.

The sequence of steps of subjecting the collapsible reservoir 2 to a positive pressure relative to the environment and of subjecting the collapsible reservoir 2 to a negative pressure relative to the environment can be repeated. In particular, by repeating this sequence of steps, the amount of gas in the collapsible reservoir 2 can be further decreased.

FIG. 5 illustrates schematically a collapsible reservoir 2 that has been filled with a predefined amount of the liquid drug 21. The pressure chamber 5 has at the inside the same environmental pressure as at the outside, for example after establishing a respective fluid communication by operation of the valve device 7. The pressure chamber 5 can be opened (not illustrated in the Figures) and used for administering the liquid drug 21 to a patient, for example in connection with a liquid drug pump, such as an insulin pump.

1 supply container
11 liquid drug stored in the supply container
12 gas stored in the supply container
13 port of the supply container
2 collapsible container
21 liquid drug stored in the collapsible reservoir
22 gas stored in the collapsible reservoir
23 port of the collapsible reservoir
3 fluid connection
4 environment connection
5 pressure chamber
6 pump device
7 valve device
8 controller
9 sensor

The invention claimed is:

1. An apparatus for transferring an amount of a liquid drug, the apparatus comprising:

a supply container storing the liquid drug;

a collapsible reservoir;

a fluid connection connected to and providing a fluidic communication between the supply container and the collapsible reservoir;

an environment connection connected to the supply container and configured to subject the liquid drug stored in the supply container to an environmental pressure; and a pressure chamber, the collapsible reservoir being arranged within the pressure chamber, the pressure chamber having a first condition subjecting the collapsible reservoir to a positive pressure relative to the environmental pressure to collapse the collapsible reservoir and transfer a gas comprised in the collapsible reservoir from the collapsible reservoir to the supply container through the fluid connection, the pressure chamber having a second condition subjecting the collapsible reservoir to a negative pressure or no pressure relative to the environmental pressure to expand the collapsible reservoir and transfer the amount of the liquid drug from the supply container to the collapsible reservoir through the fluid connection.

2. The apparatus according to claim 1, wherein the pressure chamber is configured to repeatedly subject the collapsible reservoir to consecutive application of a positive pressure and a negative pressure relative to the environmental pressure.

3. The apparatus according to claim 1, further comprising a pump device connected to the pressure chamber and in the first condition subjecting the collapsible reservoir to a positive pressure relative to the environmental pressure and/or to subject the collapsible reservoir to a negative pressure relative to the environmental pressure.

4. The apparatus according to claim 1, further comprising a valve device connected to the pressure chamber and subjecting the collapsible reservoir to the environmental pressure.

5. The apparatus according to claim 1, further comprising at least one of a pressure sensor and an optical sensor for determining a parameter reflecting the amount of remaining gas in the collapsible reservoir, and a controller for determining from the parameter the amount of remaining gas in the collapsible reservoir.

6. The apparatus according to claim 1, further comprising the supply container being positioned at a higher level above ground than the collapsible reservoir.

7. A kit comprising an apparatus according to claim 1, further comprising at least a second collapsible reservoir.

8. The apparatus according to claim 1, further comprising a controller configured to adjust the pressure chamber to have a positive pressure, a negative pressure, or no pressure relative to the environmental pressure.

9. The apparatus according to claim 8, wherein the controller is further configured to repeatedly subject the collapsible reservoir to consecutive applications of a positive pressure and a negative pressure relative to the environmental pressure.

10. The apparatus according to claim 8, and further comprising a pump device connected to the pressure chamber and configured to subject the collapsible reservoir to a positive pressure relative to the environmental pressure or to subject the collapsible reservoir to a negative pressure relative to the environmental pressure, the controller further being configured to operate the pump device to apply either the positive pressure or the negative pressure.

11. The apparatus according to claim 8, and further comprising a valve device connected to the pressure chamber and configured to subject the collapsible reservoir to the environmental pressure, the controller further being configured to operate the valve device to subject the collapsible reservoir to the environmental pressure.

12. The apparatus according to claim 8, further comprising at least one of a pressure sensor and an optical sensor for determining a parameter reflecting the amount of remaining gas in the collapsible reservoir, the controller further being configured to operate the at least one sensor and to determine from the parameter the amount of remaining gas in the collapsible reservoir.

* * * * *